US005881577A

United States Patent [19]

Sauer et al.

[11] Patent Number: 5,881,577

[45] Date of Patent: Mar. 16, 1999

[54] PRESSURE-SWING ABSORPTION BASED CLEANING METHODS AND SYSTEMS

[75] Inventors: Richard A. Sauer, Hinsdale; Jean-Luc Hubert, Clarendon Hills; Robert W. Connors, Western Springs, all of Ill.

[73] Assignee: Air Liquide America Corporation, Houston, Tex.

[21] Appl. No.: 709,656

[22] Filed: Sep. 9, 1996

[51] Int. Cl.[6] ..... B08B 3/04

[52] U.S. Cl. ..... 68/5; 68/12.08; 68/12.09; 239/136

[58] Field of Search ..... 68/5, 12.08, 12.09; 239/136

[56] References Cited

U.S. PATENT DOCUMENTS

| | | | |
|---|---|---|---|
| 2,985,003 | 5/1961 | Gelfand et al. | 68/3 R |
| 3,086,538 | 4/1963 | Voltz | 134/111 |
| 3,712,085 | 1/1973 | Guberman et al. | 68/3 SS |
| 4,012,194 | 3/1977 | Maffei | 8/142 |
| 4,199,482 | 4/1980 | Renaud et al. | 510/284 |
| 4,336,024 | 6/1982 | Denissenko et al. | 8/142 |
| 4,630,625 | 12/1986 | Capella et al. | 134/104.3 |
| 4,727,734 | 3/1988 | Kanazawa et al. | 68/355 |
| 4,824,487 | 4/1989 | Heffernan | 134/10 |
| 4,936,922 | 6/1990 | Cherry | 134/22.18 |
| 5,013,366 | 5/1991 | Jackson et al. | 134/1 |
| 5,017,423 | 5/1991 | Bossmann et al. | 442/327 |
| 5,032,148 | 7/1991 | Baker et al. | 95/50 |
| 5,035,921 | 7/1991 | Berneburg et al. | 427/226 |
| 5,064,280 | 11/1991 | Ringens et al. | 356/28.5 |
| 5,068,040 | 11/1991 | Jackson | 210/748 |
| 5,080,822 | 1/1992 | Van Eenam | 510/365 |
| 5,080,831 | 1/1992 | VanEenam | 510/365 |
| 5,158,100 | 10/1992 | Tanaka et al. | 134/105 |
| 5,196,134 | 3/1993 | Jackson | 510/175 |
| 5,213,619 | 5/1993 | Jackson et al. | 134/1 |
| 5,215,592 | 6/1993 | Jackson | 134/1 |
| 5,226,969 | 7/1993 | Watanabe et al. | 134/7 |
| 5,236,602 | 8/1993 | Jackson | 210/748 |
| 5,248,588 | 9/1993 | Winston | 430/605 |
| 5,250,078 | 10/1993 | Saus et al. | 8/475 |
| 5,267,455 | 12/1993 | Dewees et al. | 68/5 CC |
| 5,269,850 | 12/1993 | Jackson | 134/2 |
| 5,279,615 | 1/1994 | Mitchell et al. | 8/142 |
| 5,306,350 | 4/1994 | Hoy et al. | 134/22.14 |
| 5,313,965 | 5/1994 | Palen | 134/61 |
| 5,316,591 | 5/1994 | Chao et al. | 134/34 |
| 5,344,493 | 9/1994 | Jackson | 134/1 |
| 5,368,171 | 11/1994 | Jackson | 134/147 |
| 5,370,742 | 12/1994 | Mitchell et al. | 134/10 |
| 5,374,337 | 12/1994 | Ng et al. | 203/41 |
| 5,403,621 | 4/1995 | Jackson et al. | 427/255.1 |
| 5,412,958 | 5/1995 | Iliff et al. | 68/5 C |
| 5,467,492 | 11/1995 | Chao et al. | 8/159 |
| 5,482,211 | 1/1996 | Chao et al. | 239/135 |
| 5,486,212 | 1/1996 | Mitchell et al. | 8/142 |
| 5,514,220 | 5/1996 | Wetmore et al. | 134/22.18 |

FOREIGN PATENT DOCUMENTS

| | | |
|---|---|---|
| 0 679 753 A2 | 11/1995 | European Pat. Off. . |
| 39 04 514 A1 | 8/1990 | Germany . |
| 4004111 A1 | 8/1990 | Germany . |
| WO 92/14558 | 9/1992 | WIPO . |

OTHER PUBLICATIONS

Harvey Black, *A Cleaner Bill of Health,* Environmental Health Perspectives, May 1996, (3 pgs. Total).

*Primary Examiner*—Scott W. Houtteman
*Attorney, Agent, or Firm*—Burns, Doane, Swecker & Mathis

[57] ABSTRACT

The cleaning process according to the present invention includes three main steps including supercritical extraction of soluble contaminants with a solvent composition, subcritical removal of particulate material with agitation, and solvent recovery and recycle. The supercritical extraction of soluble contaminants is performed by pumping a solvent composition into a cleaning vessel containing articles to be cleaned and pressurizing and heating the fluid in the vessel to a supercritical state. Then the subcritical phase is begun to remove particulate material from the articles by reducing the pressure and temperature of the solvent composition in the cleaning vessel to a subcritical state and reforming the liquid/gas interface. Agitation of the articles in the cleaning vessel is provided by recirculation of the solvent composition or by motion of a mechanical device within the cleaning vessel. Due to a density difference between gas and liquid in the subcritical phase, the degree of agitation and resultant particulate removal is maximized. The solvent composition recovery step preferably includes further depressurization of the fluid to separate and remove soluble and insoluble contaminants from the fluid, allowing this solvent composition to be reused. The system may be operated with any gas with suitable solvent properties such as carbon dioxide, carbon dioxide based mixtures, or other known solvents.

43 Claims, 3 Drawing Sheets

PRESSURE-SWING ABSORPTION BASED CLEANING METHODS AND SYSTEMS

This application is related to U.S. patent application Ser. No. 08/709,655, filed on Sep. 9, 1996 entitled "Continuous Cleaning Apparatus and Method" which is incorporated herein by reference.

BACKGROUND OF THE INVENTION

1. Field of the Invention

The present invention relates to a cleaning system using a supercritical fluid as a solvent, and more particularly to the extraction of contaminants from articles by a cleaning process incorporating a pressure swing absorption of the contaminants in the solvent.

2. Description of the Related Art

Conventional solvent-aided cleaning processes for cleaning sensitive substrates such as fabrics or delicate electronic components have generally used dry cleaning solvents such as perchloroethylene. Due to concerns of air pollution, potential ozone depletion, occupational health and safety, and waste disposal, conventional dry cleaning solvents are being replaced with other less hazardous cleaning fluids. For these reasons, the eventual replacement of petroleum based solvents and chlorinated hydrocarbons as solvents would be desirable.

The use of a supercritical fluid or fluid mixture is being investigated as an alternative to conventional dry cleaning solvents. A supercritical fluid is a fluid which is capable of being compressed and heated to a state that exhibits high relative density and solvency compared to a gas under normal conditions while maintaining a low viscosity and surface tension. These properties make supercritical fluids desirable for use as solvents in cleaning processes. In particular, supercritical carbon dioxide has been used in garment cleaning processes to remove contaminants from garments.

One such cleaning system using supercritical carbon dioxide for cleaning of fabrics is disclosed in U.S. Pat. No. 5,267,455. In that system the cleaning is accomplished by agitation of the clothing within a pressurized vessel containing carbon dioxide in a supercritical state. The carbon dioxide is then drained, vaporized and then condensed to remove the contaminants which have been removed from the fabric. The carbon dioxide may then be reused in the cleaning system. Although the supercritical carbon dioxide in the system of U.S. Pat. No. 5,267,455 will remove many soluble contaminants such as oils and fats, it would be desirable to also remove particulate material which does not dissolve in the supercritical carbon dioxide.

SUMMARY OF THE INVENTION

The methods and systems according to the present invention address the disadvantages of the prior art by effectively and efficiently removing both soluble and particulate contaminants from sensitive substrates with a supercritical fluid or solvent composition. As used herein, the term "solvent composition" means a composition comprising at least one supercritical fluid, which may optimally contain surfactants, brighteners, coupling agents, and the like. The solvent composition used herein can be used at either at a supercritical state or at a subcritical state.

One aspect of the present invention relates to a method of cleaning articles by pressure swing absorption with a solvent composition comprising a supercritical fluid, including steps of: loading a pressure vessel with articles to be cleaned; pressurizing and heating the solvent composition within the pressure vessel to a supercritical state of the solvent composition; removing soluble contaminants from the articles by maintaining contact between the articles and the solvent composition in the supercritical state; depressurizing and cooling the solvent composition within the pressure vessel to a pressure at which said solvent composition is at subcritical state; removing particulate contaminants from the articles by agitating the articles and the solvent composition in the subcritical state within the pressure vessel; removing and recycling the solvent composition from the pressure vessel; and unloading the cleaned articles from the pressure vessel.

The present invention also relates to a cleaning system for cleaning articles with a solvent composition comprising a supercritical fluid, the system including a pressure vessel, a solvent composition supply, pressurization and heating means for pressurizing and heating the solvent composition to a supercritical state, depressurization and cooling means for depressurizing and cooling the solvent composition to a subcritical state, agitation means for agitating the solvent composition within the pressure vessel, recovery means for recycling at least a portion of the solvent composition by removing contaminants from the solvent composition, and control means for controlling the pressurization and heating means, the depressurization and cooling means, and the agitation means such that the system provides a first supercritical cleaning stage for removal of soluble contaminants and a second subcritical agitation cleaning stage for removal of particulate contaminants.

BRIEF DESCRIPTION OF THE DRAWING FIGURES

The invention will be described in greater detail with reference to the accompanying drawings in which like elements bear like reference numerals, and wherein.

DETAILED DESCRIPTION

Figure 1:
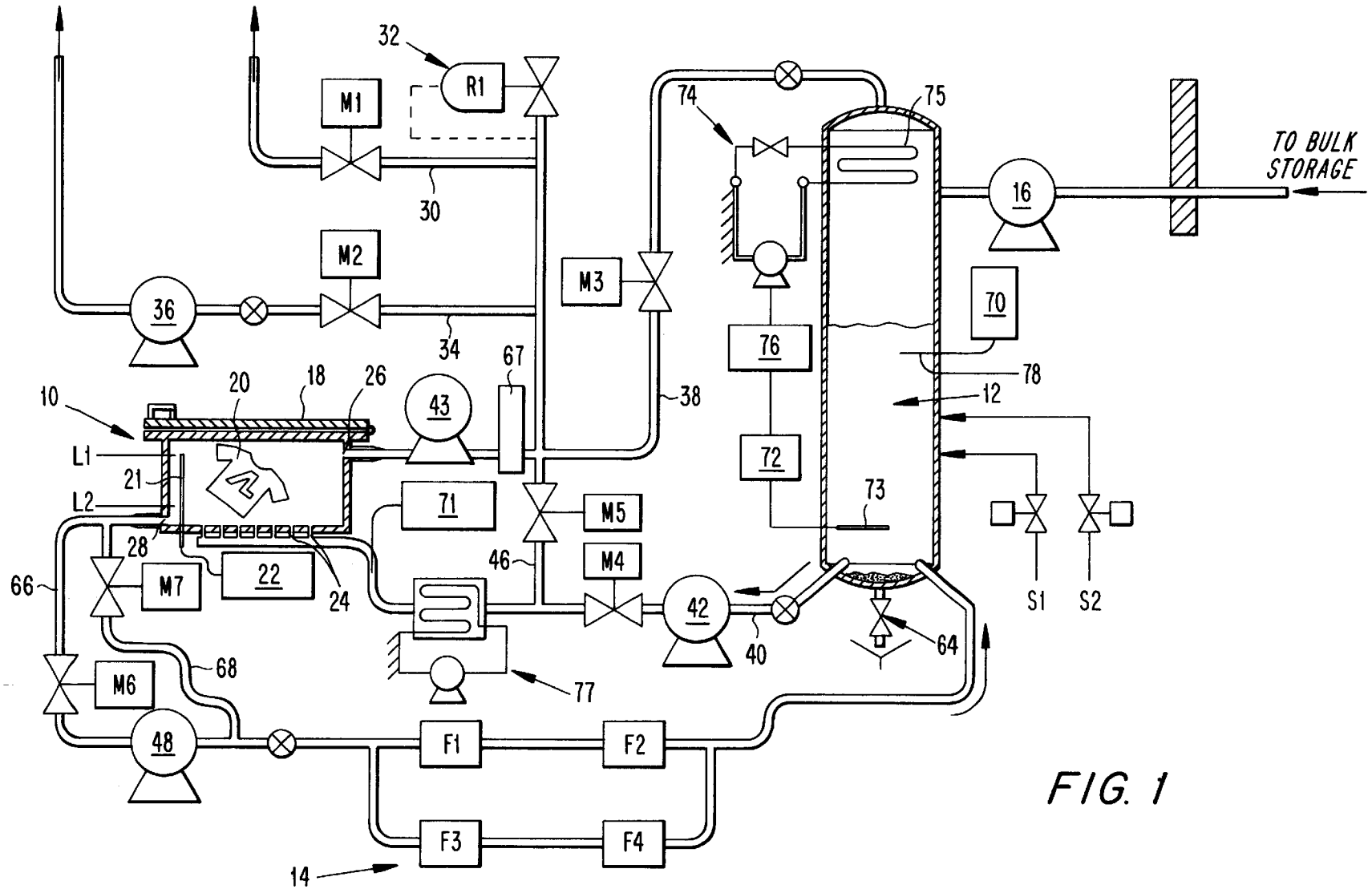
FIG. 1 is a schematic view of a cleaning system according to the present invention.

The cleaning process according to the present invention includes three main steps including supercritical extraction of soluble contaminants with a solvent composition in a supercritical state, subcritical removal of particulate material with agitation of the solvent composition at a subcritical state, and solvent composition recovery and recycle. The supercritical extraction of soluble contaminants is performed by pumping the solvent composition into a cleaning vessel 10 containing articles 20 to be cleaned, such as articles of clothing, and pressurizing and heating this solvent composition in the vessel to a supercritical state. The subcritical agitation stage removes particulate material by reducing the pressure and temperature in cleaning vessel 10 to a subcritical condition at which a liquid/gas interface exists in the solvent composition and by providing mechanical agitation. The solvent composition recovery step preferably includes further depressurization of the solvent composition to separate soluble contaminates from the solvent composition, filtration of the solvent composition to remove insoluble contaminants, and distillation (i.e., evaporation and condensation) of a portion of the solvent composition to, remove additional contaminants.

The system may be operated with any solvent composition with suitable solvent properties such as carbon dioxide, carbon dioxide based mixtures or other known solvents such as xenon, nitrous oxide, sulfur hexafluoride, ethane, ethylene, acetylene and mixtures of above. Preferably, the solvent composition is a composition having a critical temperature near ambient and a low critical pressure. A preferred solvent composition for use in the cleaning system of the present invention is a carbon dioxide based fluid comprising a mixture of carbon dioxide and several co-solvents and/or surfactants.

The surfactant used may be an anionic, nonionic, cationic or amphoteric surfactant. Illustrative anionic surfactants for use in the invention include dodecylbenzene sulfonic acid, sodium dodecylbenzene sulfonate, potassium dodecylbenzene sulfonate, triethanolamine dodecylbenzene sulfonate, morpholinium dodecylbenzene sulfonate, ammonium dodecylbenzene sulfonate, isopropylamine dodecylbenzene sulfonate, sodium tridecylbenzene sulfonate, sodium dinonylbenzene sulfonate, potassium didodecylbenzene sulfonate, dodecyl diphenyloxide disulfonic acid, sodium dodecyl diphenyloxide disulfonate, isopropylamine decyl diphenyloxide disulfonate, sodium hexadecyloxypoly(ethyleneoxy)(10)ethyl sulfonate, potassium octylphenoxypoly(ethyleneoxy)(9)ethyl sulfonate, sodium alpha olefin sulfonate, sodium hexadecane-1 sulfonate, sodium ethyl oleate sulfonate, potassium octadecenylsuccinate, sodium oleate, potassium laurate, triethanolamine myristate, morpholinium tallate, potassium tallate, sodium lauryl sulfate, diethanolamine lauryl sulfate, sodium laureth (3) sulfate, ammonium laureth (2) sulfate, sodium nonylphenoxypoly(ethyleneoxy)(4) sulfate, sodium diisobutylsulfosuccinate, disodium lauryl-sulfosuccinate, tetrasodium N-laurylsulfosuccinimate, sodium decyloxypoly(ethyleneoxy(5)methyl)carboxylate, sodium octylphenoxypoly(ethyleneoxy(8)methyl)-carboxylate, sodium mono decyloxypoly(ethyleneoxy)(4)phosphate, sodium di decyloxypoly(ethyleneoxy)(6)phosphate, and potassium mono/di octylphenoxypoly(ethyleneoxy)(9) phosphate. Other anionic surfactants known in the art may also be employed.

Among the useful nonionic surfactants which may be employed are octylphenoxypoly(ethyleneoxy)(11)ethanol, nonylphenoxypoly(ethyleneoxy)(13)ethanol, dodecylphenoxypoly(ethyleneoxy)(10)ethanol, polyoxyethylene (12) lauryl alcohol, polyoxyethylene (14) tridecyl alcohol, lauryloxypoly(ethyleneoxy)(10)ethyl methyl ether, undecylthiopoly(ethyleneoxy) (12)ethanol, methoxypoly (oxyethylene(10)/(oxypropylene(20))-2-propanol block co-polymer, nonyloxypoly(propyleneoxy)(4)/(ethyleneoxy) (16)ethanol, dodecyl polyglycoside, polyoxyethylene (9) monolaurate, polyoxyethylene (8) monoundecanoate, polyoxyethylene (20) sorbitan monostearate, polyoxyethylene (18) sorbitol monotallate, sucrose monolaurate, lauryldimethylamine oxide, myristyldimethylamine oxide, lauramidopropyl-N,N-dimethylamine oxide, 1:1 lauric diethanolamide, 1:1 coconut diethanolamide, 1:1 mixed fatty acid diethanolamide, polyoxyethylene(6)lauramide, 1:1 soya diethanolamidopoly(ethyleneoxy) (8) ethanol, and coconut diethanolamide. Other known nonionic surfactants may likewise be used.

Illustrative useful cationic surfactants include a mixture of n-alkyl dimethyl ethylbenzyl ammonium chlorides, hexadecyltrimethylammonium methosulfate, didecyldimethylammonium bromide and a mixture of n-alkyl dimethyl benzyl ammonium chlorides. Similarly useful amphoteric surfactants include cocamidopropyl betaine, sodium palmityloamphopropionate, N-coco beta-aminopropionic acid, disodium N-lauryliminodipropionate, sodium coco imidazoline amphoglycinate and coco betaine. Other cationic and amphoteric surfactants known to the art may also be utilized.

The co-solvents which may be utilized in the practice of the present invention include sodium benzene sulfonate, sodium toluene sulfonate, sodium xylene sulfonate, potassium ethylbenzene sulfonate, sodium cumene sulfonate, sodium octane-1-sulfonate, potassium dimethylnaphthalene sulfonate, ammonium xylene sulfonate, sodium n-hexyl diphenyoxide disulfonate, sodium 2-ethylhexyl sulfate, ammonium n-butoxyethyl sulfate, sodium 2-ethylhexanoate, sodium pelargonate, sodium n-butoxymethyl carboxylate, potassium mono/di phenoxyethyl phosphate, sodium mono/di n-butoxyethyl phosphate, triethanolamine trimethylolpropane phosphate, sodium capryloamphopropionate, disodium capryloiminodipropionate, and sodium capro imidazoline amphoglycinate. Certain water-soluble solvents known to the art such as propylene glycol ethers (e.g. tripropyleneglycol monomethyl ether) can be used in the practice of the invention. Additional co-solvents known to the art may also be utilized.

Although the temperatures and pressures employed in the present invention will be described in terms of the temperatures and pressures for a system using a pure carbon dioxide solvent, it should be understood that one of ordinary skill in the art would be able to determine the appropriate operating temperatures and pressures for other carbon dioxide based solvent compositions based on the disclosure for pure carbon dioxide. These temperatures and pressures for other carbon dioxide base solvents will be similar to those for pure carbon dioxide. The temperatures and pressures for non-carbon dioxide based solvent mixtures will depend on the individual material properties of the pure solvents.

The cleaning system according to the present invention operates by removing contaminants by a pressure swing absorption of the contaminants in the solvent composition. Pressure swing absorption refers to the operation of a fluid containing system between two pressures with impurities being absorbed at a high pressure and desorbed at a low pressure. In the present application, contaminants are absorbed from the articles to be cleaned at the high pressure and the contaminants are desorbed and removed from the solvent composition at the low pressure.

FIG. 1 illustrates the cleaning system according to the present invention including cleaning vessel 10, a central storage tank 12, and a central filtration system 14. The solvent composition is stored outdoors in a bulk storage tank (not shown) and is pumped from the bulk storage tank into central storage tank 12 by a boost pump 16. The pressure of the solvent composition in central storage tank 12 is maintained above a pressure at which the temperature of the fluid would be at least 32° F. This prevents any water which may be present in central storage tank 12 or in the rest of the cleaning system from freezing. The pressure of the solvent composition in central storage tank 12 is maintained as low as possible so as to minimize the contaminant holding capacity (chemical potential) of the fluid in order to precipitate out any contaminants which may be remaining in the fluid. The pressure in central storage tank 12 when using carbon dioxide as a solvent composition is between 510 psig (3517 kPa) and 1057 psig (7290 kPa), preferably between 550 psig (3793 kPa) and 1000 psig (6897 kPa), and most preferably approximately 575 psig (3966 kPa). Central storage tank 12 includes a blow down drain 64 for removing stratified contaminants from the tank and for draining the contents of the storage tank in order to replace the solvent composition with clean fluid. Due to the use of central filtration system 14 and distillation system (not shown), this replacement of the solvent composition will need to be performed infrequently.

The desired chemical potential of the solvent composition in central storage tank 12 is maintained by controlling the pressure of the solvent composition in the central storage tank. The pressure of the solvent composition in the central storage tank 12 may be controlled by a control system including a controller 76, a heater 72, and a refrigeration system 74. Heater 72 includes a heating element 73 which is positioned within the liquid space in central storage tank 12. Refrigeration system 74 includes a refrigeration coil 75 within the vapor space of central storage tank 12. The pressure control system activates heater 72 to vaporize liquid if the pressure within central storage tank 12 is too low, or activates refrigeration system 74 to condense some of the vapor if the pressure is too high.

Cleaning vessel 10 is a high pressure cleaning vessel capable of withstanding pressures up to several thousand psig and having a hinged vessel lid 18 or other means which may be opened to load and unload articles 20 to be cleaned from the vessel. Cleaning vessel 10 includes a level sensor 21 and a level controller 22 which are used in controlling the solvent composition level in the cleaning vessel during the filling and draining cycles. Level sensor 21 may be any known level indicator such as a capacitance probe, float, bubbler with delta-P cell, sightglass, or the like. Cleaning vessel 10 includes one or more solvent composition drain ports 24 which have been illustrated along the lower surface of the cleaning vessel, and at least one solvent composition injection port 26 near the top of the vessel. Injection port 26 may be located on one or more of the surfaces of the cleaning vessel including the side, top, or bottom surfaces, while drain ports 24 must be located at or near the bottom surface of the cleaning vessel. Cleaning vessel 10 may also includes a separate drainage port 28 for draining solvent composition from the cleaning vessel and delivering this fluid to central filtration system 14.

Cleaning vessel 10 includes a mechanism for agitating articles 20 in the vessel during the subcritical agitation stage of the cleaning process to remove particulate material from the articles more effectively than during the homogenous supercritical stage. The vapor/liquid interface in the solvent composition is reformed during this subcritical phase resulting in a more vigorous agitation of the articles due to the difference in density between the vapor and liquid phases. FIG. 1 illustrates one embodiment of an agitation mechanism utilizing a solvent composition recirculation system. The recirculation system includes a high pressure recirculation pump 43 which draws solvent composition from cleaning vessel 10 by the drain ports 24 and reinjects it through a port 26 at articles 20 within in the vessel. The recirculation system may include an optional filtration system 67, containing one or more filters for removal of particulates and/or soluble contaminants directly from the recirculation loop. The recirculation loop will also include a heater 71 to put heat into the solvent composition to enter the supercritical stage and a cooler 77 to remove heat in order to reenter the subcritical stage.

Optionally to conserve energy, the refrigeration system may use a closed loop with a heat transfer fluid, a buffer tank, and a recirculation pump to store the heat released by the evaporator coils of the refrigeration system 77 for reuse during subsequent heating cycles with the use of a fluid heat exchanger in the recirculation loop of the cleaning vessel 10.

Figure 3:
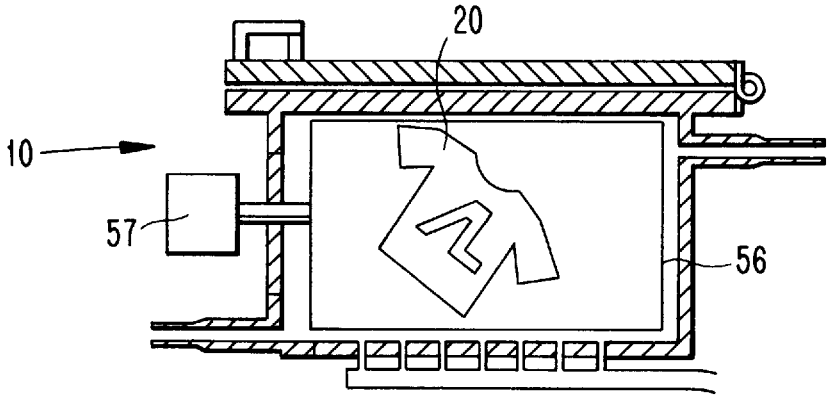
FIG. 3 is a schematic view of a first embodiment of a cleaning vessel agitation mechanism.

FIG. 3 illustrates a second embodiment of an agitation mechanism including a reversible, rotating basket 56 to hold the articles within cleaning vessel 10. The basket is rotated by motor 57 which causes the solvent composition and articles 20 to be agitated within the vessel. While the proposed agitation mechanism is illustrated as a reversing, rotating basket, other agitation mechanisms may also be used, such as, an impeller, propeller, or other agitator device. The agitation mechanism helps to remove particulate material from the articles which was not absorbed in the supercritical absorption stage.

Figure 4:
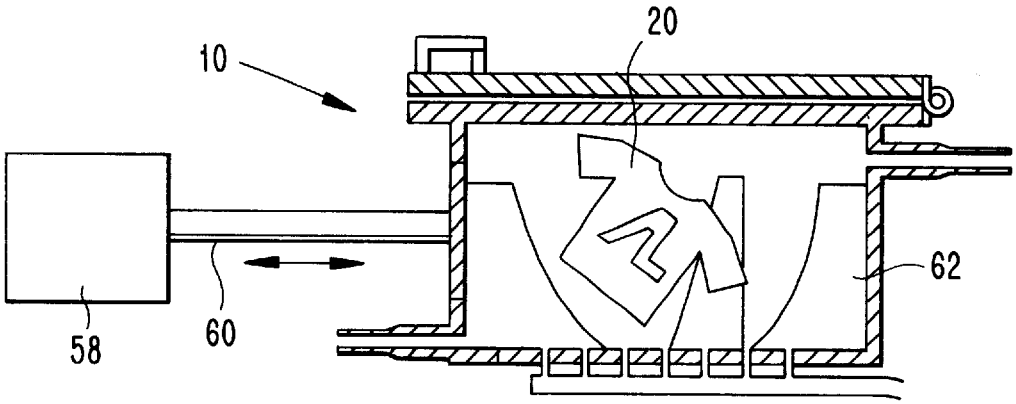
FIG. 4 is a schematic view of a second embodiment of a cleaning vessel agitation mechanism.

A third embodiment of an agitation mechanism is illustrated in FIG. 4. The FIG. 4 embodiment includes a linear motion drive device 58 and a drive shaft 60 attached to the outside of cleaning vessel 10. This embodiment may also include internal baffles 62 which promote greater agitation of articles 20 and the solvent composition within the vessel. Alternatively, a rotary drive device may be provided in place of the linear drive device which provides agitation by rotating cleaning vessel 10.

A purging system is provided for purging cleaning vessel 10 after articles 20 to be cleaned have been placed in the cleaning vessel. The purging system includes a first vent pipe 30 including a valve M1, a back pressure regulator 32 and an optional rupture disk R1. The purging system also includes a second vent pipe 34 having a vacuum pump 36 and a valve M2 for evacuating the initial air from cleaning vessel 10. The first and second vent pipes 30, 34 are also connected to central storage tank 12 by a purge pipe 38 including a valve M3 for purging cleaning vessel 10 with solvent composition vapor.

The solvent composition is supplied to cleaning machine 10 by a supply pipe 40 including a filling pump 42 and a regulating valve M4. Supply pipe 40 is connected to the recirculation loop containing pipe 46 and having valve M5.

According to one embodiment of the invention of FIG. 1, a solvent analysis may be performed periodically on the solvent composition in central storage tank 12 to check the levels of the various components of the solvent composition. A solvent analyzer 70 is shown in FIG. 1 including a probe 78 which extends into central storage tank 12. In the event that the component levels in central storage tank 12 are different from the desired levels, the levels may be corrected by the addition of amounts of components from supplies S1, S2 to central storage tank 12 or to other locations in the system. The number of component supplies S1, S2 . . . Sn provided can be varied and will depend on the number of components in the solvent composition which is used.

The cleaning system according to the present invention also includes a drainage system for draining and recycling the solvent composition from cleaning vessel 10 after use. The drainage system includes central filtration system 14 illustrated in FIG. 1. The drainage system includes a first drainage pipe 68 having a depressurization valve M7 and a second drainage pipe 66 having a drainage valve M6 and a drainage pump 48. The solvent composition which is drained from cleaning vessel 10 flows to the central storage tank via central filtration system 14.

Once the pressurized solvent composition contacts articles 20 to be cleaned within the cleaning vessel 10, contaminants become entrained in and contaminate the fluid. In accordance with the present invention, the solvent composition leaving cleaning vessel 10 is depressurized from a subcritical pressure of about 1000 psig (6896 kPa) to the pressure of central storage tank 12 of about 575 psig (3966 kPa). This pressure drop causes desorption of a large percentage of the soluble contaminants from the solvent composition. The pressurized solvent composition is then rejuvenated by the central filtration system 14 and the distillation system (not shown) to remove soluble and insoluble contaminants and prevent recontamination of the articles.

The central filtration system 14 illustrated in FIG. 1 includes filters F1, F2, F3 and F4. As shown in FIG. 1, the filters F1 and F2 are positioned in a parallel arrangement with the filters F3 and F4. The illustrated central filtration system 14 is a simple filtration system which is shown by way of example. Other more complex filtration systems may also be used in place of central filtration system 14. These more complex filtration systems may include a combination of filters of graduated sizes for filtering a portion of the solvent composition and an evaporator and condenser for removing contaminants from another portion of the solvent composition stream. The evaporator and condenser (i.e., distillation column) would preferably be adjacent the central storage tank.

Operation

In operation of the cleaning system according to the present invention which is illustrated in FIG. 1, central storage tank 12 is filled with solvent composition from the outside bulk storage tank by operation of boost pump 16. The concentrations of the various components of the solvent composition within central storage tank 12 then may be checked by solvent analyzer 70 and corrected, if necessary by adding the necessary additives or co-solvents from component supplies S1, S2 . . . Sn.

Articles 20 are loaded into cleaning vessel 10 and vessel lid 18 is closed and sealed. The initial air is then evacuated from cleaning vessel 10 by opening valve M2 and operating vacuum pump 36. Following the air evacuation step, cleaning vessel 10 is purged with solvent composition vapor by opening valve M3 and allowing pressurized vapor or purge gas from central storage tank 12 to pass into the cleaning vessel. This purge gas is then vented from cleaning vessel 10 by closing valve M3 and opening valve M1 to the atmosphere. The purpose of the purging step is to more completely remove non-condensible air from the cleaning vessel. The valves M1 and M2 are then closed in preparation for final pressurization of the vessel with solvent composition vapor. The entire evacuation and purging of cleaning vessel 10 may take approximately two minutes.

After evacuation and purging have been completed, cleaning vessel 10 is pressurized to the pressure of central storage tank by opening the valve M3. This pressurization may take about one minute. Cleaning vessel 10 is then partially filled with pressurized solvent composition by closing valve M3 and operating filling pump 42 via valve M4. Depending on the size of the cleaning vessel 10 and the filling pump 42 used, the solvent composition filling stage may take about 10 minutes. Cleaning vessel 10 is preferably filled to a point that is between L1, where the level of the liquid substantially fills the vessel and L2 where the vessel is empty. Recirculation pump 43 and heater 71 are then used to fully pressurize the solvent composition to supercritical conditions of 1057 psig (7290 kPa) to several thousand psig (tens of thousands of kPa), preferably 1200 psig (8276 kPa) to 1500 psig (10,345 kPa). The temperature of the solvent composition at this phase is at least 89° F. (31.7° C.), preferably 90° F. to 100° F. (32.2° C. to 37.8° C.). Recirculation pump 43 operates at a high flow rate and a small boost pressure. In contrast, filling pump 42 operates with a small flow rates but a high degree of pressurization. A single pump which can achieve both high flow rates and high pressurization may be used in place of recirculation pump 43 and filling pump 42.

The recirculation provided by recirculation pump 43 provides minimal mechanical agitation of the solvent composition and of articles 20 in cleaning vessel 10 during the supercritical stage due to the lack of a vapor/liquid interface in the supercritical state. One of the forms of mechanical agitation previously illustrated in FIGS. 3–4 may be utilized to enhance the agitation and resultant mass transfer of contaminants into the solvent composition. The recirculation of the solvent composition will continue to extract the soluble contaminants from the article for some time, typically, at least 5 minutes and preferably 5 to 10 minutes. However, the cleaning time will depend on the amount and type of soluble contaminants to be removed. During this supercritical extraction stage the solvent composition is used to dissolve and remove oil and water soluble contaminants including non-polar contaminants such as oils, grease, and fats, and polar contaminants such as organic salts from the fabric or other articles, due to the high solvency of the solvent composition in the supercritical state. During the supercritical extraction stage the pressure and temperatures within cleaning vessel 10 are controlled by heater 71, refrigeration system 77, and back pressure regulator 32.

After the supercritical extraction stage, cleaning vessel 10 is depressurized to a pressure of 570 psig (3931 kPa) to 1057 psig (7290 kPa), preferably approximately 1000 psig (6897 kPa), and between 40° F. and 90° F. (between 4.4° C. and 32.2° C.), by opening depressurization valve M7 and by activating the refrigeration loop until a desired subcritical pressure is achieved. At the subcritical stage, a vapor/liquid interface is reformed in the solvent composition. Solvent recirculation and one of the forms of mechanical agitation illustrated in FIGS. 3–4 will continue to be performed to agitate articles 20 and the solvent composition within cleaning vessel 10. This agitation in the subcritical stage removes any particulate material which is present on the articles that cannot be dissolved by the solvent composition in the supercritical state. The mechanical impact of the subcritical fluid is greater than the impact which can be provided by a supercritical fluid because of the density difference between the liquid and gas phases of the fluid. The subcritical agitation stage is preferably conducted for about 5 to 10 minutes. However, this time period may be varied depending on the amount and type of particulate material to be removed.

Optionally, a second washing cycle or a rinse cycle may be used after the subcritical agitation stage. The second washing cycle includes draining the spent solvent composition, refilling cleaning vessel 10 with clean solvent composition, and repressurization to either subcritical or supercritical conditions as required. Either the supercritical stage, the subcritical stage, or both stages may be used for the second and any subsequent washing or rinsing cycles.

At the completion of the washing cycle(s) valve M5 is closed and pressure let down valve M7 is opened to depressurized cleaning vessel 10 and allow the liquid solvent composition to pass to central filtration system 14. The pressure within the cleaning vessel and return pump 48 are then used to empty the solvent composition from cleaning vessel 10 back into central tank 12. The opening of pressure let down valve M7 causes the solvent composition to be depressurized to the pressure of the central storage tank 12.

This depressurization of the solvent composition causes most of the absorbed soluble contaminants to be desorbed from the fluid. The solvent composition drained from cleaning vessel 10 is filtered by central filtration system 14 en route to central tank 12 in order to remove the previously soluble contaminants which have been desorbed from the solvent composition and the insoluble contaminants in the fluid including particles as small as low micron size. The cleaned solvent composition is then returned to central storage tank 12 where it can be used in subsequent cleaning processes. The vapors of solvent composition remaining in cleaning vessel 10 at 575 psig (3966 kPa) (the pressure of central storage tank 12) are then vented to the atmosphere by opening valve M1 so that the cleaning vessel returns to atmospheric pressure prior to opening vessel lid 18 and removing articles 20. Alternatively, these pressurized vapors from cleaning vessel 10 at 575 psig (3966 kPa) could be sent back to the central storage tank headspace at 285 psig (1966 kPa) and condensed thereby saving 50% of the vapor loss. With additional compression/liquification equipment, all of this vapor could be recovered.

Some contaminants remaining in the solvent composition after filtration will come out of solution in central storage tank 12 and will stratify on the bottom of the tank. These contaminants can be periodically removed via blow down valve 64. In order to enhance contaminant separation in central storage tank 12, a variety of mass transfer operations may be employed to improve contaminant removal including, for example, a periodic depressurization of central storage tank 12 to below 570 psig (3931 kPa) or a single stage thermal distillation in a separate vessel.

There will generally be some loss of the solvent composition during the cleaning process due to the venting of solvent vapors and other losses such as filtration or tank blow down. Therefore, it will be necessary to top off the level of solvent composition in central storage tank 12 either periodically or continuously during the cleaning process and to provide a level sensor for determining the level of solvent composition.

Multiple Cleaning Vessel System

Figure 2:
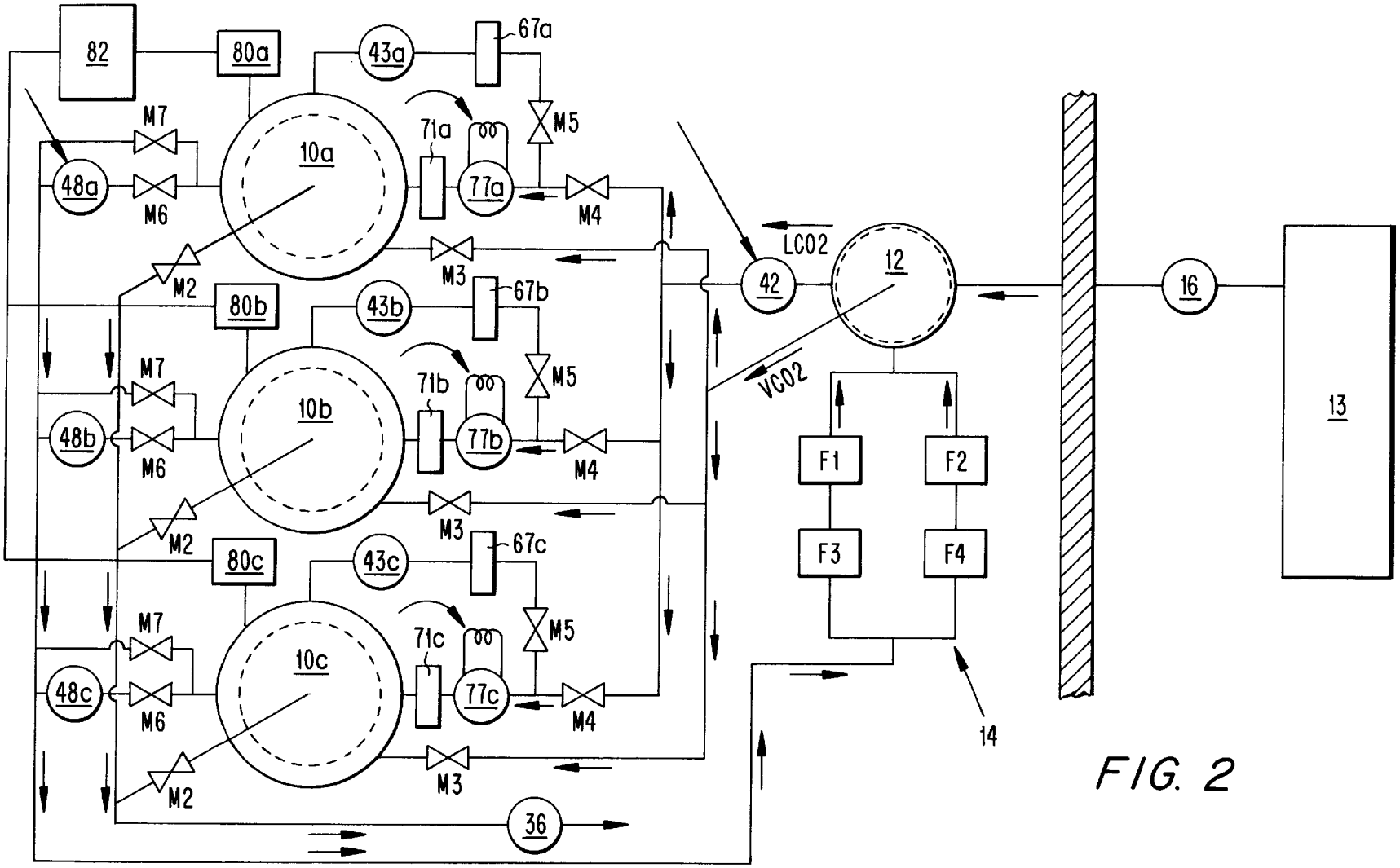
FIG. 2 is a schematic view of a cleaning system according to the present invention incorporating multiple cleaning vessels.

A multiple cleaning vessel system is illustrated in FIG. 2 and includes three cleaning vessels 10*a*, 10*b*, 10*c* operating with a single central storage tank 12, outdoor bulk storage tank 13, and central filtration system 14 connected to the three cleaning vessels. Although FIG. 2 illustrates three cleaning vessels, the system may include as many as twenty or more cleaning vessels as would be used in a commercial dry cleaning facility. Like elements in the multiple cleaning vessel system have been provided with the like reference numerals.

The system of FIG. 2 includes a single filling pump 42 associated with cleaning vessels 10*a*, 10*b*, 10*c* which is operated to pressurize the cleaning vessels. Three recirculation pumps 43*a*, 43*b*, 43*c* are provided to recirculate the solvent composition in the respective cleaning vessels during the cleaning processes. The respective recirculation systems also each include heaters 71*a*, 71*b*, 71*c*, refrigeration systems 77*a*, 77*b*, 77*c*, and filtration systems 67*a*, 67*b*, 67*c*. The system also includes three drainage pumps 48*a*, 48*b*, 48*c* associated with cleaning vessels 10*a*, 10*b*, 10*c* for draining the solvent composition from the cleaning vessels and pumping the contaminated solvent composition to the central filtration system 14. As in the embodiment of FIG. 1, the system includes a central filtration system 14 including four filters F1, F2, F3, F4.

The operation of the valves M2, M3, M4, M5, M6, M7, and the pumps 16, 36, 42, 43*a–c*, and 48*a–c* in the multiple vessel system of FIG. 2 are substantially the same as the operation of these elements in the embodiment of FIG. 1 except each unit is operated independently. Therefore, the description of their operation will not be repeated. Although the valve M1 for evacuation of the vapor in the cleaning vessels to the atmosphere and the back pressure regulator are not illustrated in FIG. 2, it should be understood that an evacuation and a back pressure regulator valve for each cleaning vessel 10*a*, 10*b*, 10*c* may be included.

According to a preferred embodiment of the invention, control panels 80*a*, 80*b*, 80*c* are preferably provided at each of the cleaning vessels 10*a*, 10*b*, 10*c* for controlling the individual operation of the cleaning vessels. These control panels 80*a*, 80*b*, 80*c* are preferably connected to a central control system 82 which controls the operation of the numerous valves and pumps of the multiple cleaning vessel system. Alternatively, separate control systems may be provided for each of the cleaning vessels, the central storage tank, and the filtration system.

In alternative embodiments of the systems of the invention, a filtration and solvent recovery system may be employed, which combines filtration, adsorption, and evaporation, of the solvent composition as described below.

In one embodiment, a primary flow of the pressurized solvent composition is cycled from the cleaning vessel through at least one filter to remove contaminants from the pressurized supercritical fluid in the primary flow while a secondary flow of the pressurized solvent composition is cycled to an evaporator/condenser system to remove contaminants.

A series of filters positioned along primary flow line may be employed, although it is possible that the use of only one filter may be adequate to remove contaminants from the pressurized solvent composition. The use of several filters connected in series, enhances the transfer and removal of contaminants from the pressurized solvent composition of the primary flow.

A prefilter may be provided for removal of larger insoluble contaminants, and is preferably constructed of woven nylon or other material having a mesh size of between about 50 and 100. Positioned downstream of the prefilter along the primary flow line may be a first filter for the removal of additional insoluble contaminants that are entrained within the primary flow of pressurized carbon dioxide. This first filter preferably has a particle retention capability of between about 5 and 50 microns, depending upon the requirements of the particular system. A cartridge filter having a suitable septum, such as paper, polypropylene, glass, or similar non-woven substrate is preferred for this first filter, although a diatomaceous earth filter or a powderless filter with an appropriate septum may also be used. If necessary or desired, additional filters of similar or finer mesh than that of first filter may be provided downstream of the first filter for enhanced filtration of insoluble contaminants.

Other embodiments may include an adsorptive filter positioned downstream of first filter, for the control and removal of undesirable soluble contaminants, such as fugitive dyes obtained from clothes or other substrates during the cleaning process. Generally, adsorbents that may be used include activated carbon, clay, or a combination of the two.

A polishing filter may be positioned along the primary flow line if desired, or if required due to the sensitive nature of the substrate. The preferred construction of a polishing filter is a string wound filter or microporous cartridge filter having a particle retention capability of about 1 micron. After passing through the filters in this embodiment, the primary flow of pressurized solvent composition is cycled back to the cleaning vessel through a return line.

The filtration systems in accordance with the present invention, may include directing a secondary flow of the solvent composition from the cleaning vessel to an evaporator to evaporate a portion of the pressurized solvent composition of the secondary flow into a vapor in order to separate contaminants therefrom. Any soluble or insoluble contaminants entrained in the pressurized solvent composition of the secondary flow are separated as a residue, which is easily collected in a conventional manner. Evaporation further aids in reducing the quantity of contaminants in the pressurized fluid solvent to within an acceptable level.

A variety of evaporator configurations and designs are available for use in the above described embodiments of the system, for example, evaporation can be performed by adjusting the temperature within an evaporator, or by adjusting the pressure within the evaporator, or by a combination of the two. The heat exchanger of the evaporator may be a heat pump configuration, a combination of heating and cooling coils, or any other conventional temperature control device. Likewise, the pressure regulator of the evaporator may be a conventional pressure control valve, although the preferred embodiment also includes a compressor pump for increasing pressure within the evaporator as necessary.

Once the pressurized solvent composition is evaporated, several options are available. In accordance with one embodiment, a condenser may be provided to liquify the vapor from the evaporator and create rejuvenated solvent composition substantially free of contaminants. The term "liquify" as used herein refers to altering a vapor from a gaseous state to a liquid state or to either a subcritical or a supercritical condition. This is performed by returning the temperature and pressure parameters within the condenser to the same or similar operating parameters to the remainder of the system.

While the invention has been described in detail with reference to preferred embodiments thereof, it will be apparent to one skilled in the art that various changes can be made, and equivalents employed without departing from or narrowing the scope of the claims.

What is claimed is:

1. A method of cleaning articles by pressure swing absorption with a solvent composition comprising a supercritical fluid, the method comprising:

loading a pressure vessel with articles to be cleaned;

pressurizing and heating the solvent composition to a supercritical state of the solvent composition;

removing soluble contaminants from the articles by maintaining contact between the articles and the solvent composition in the supercritical state;

depressurizing and cooling the solvent composition within the pressure vessel to a subcritical state of the solvent composition;

removing particulate contaminants from the articles by agitating the articles and the solvent composition in the subcritical state within the pressure vessel;

removing the solvent composition from the pressure vessel; and unloading the cleaned articles from the pressure vessel.

2. The method of cleaning articles according to claim 1, wherein the pressure vessel is pressurized with a carbon dioxide based solvent composition.

3. The method of cleaning articles according to claim 1, wherein the pressure vessel is pressurized with a solvent composition which includes at least one of a surfactant, a brightener, and a coupling agent.

4. The method of cleaning articles according to claim 1, wherein the pressure vessel is pressurized with a solvent composition which includes at least two solvents.

5. The method of cleaning articles according to claim 1, wherein at least a portion of the solvent composition is withdrawn from the pressure vessel and is recirculated back to the pressure vessel during the removal of soluble contaminants from the articles in the supercritical state.

6. The method of cleaning articles according to claim 5, wherein soluble contaminants are removed from the solvent composition continuously during said recirculation.

7. The method of cleaning articles according to claim 5, wherein soluble contaminants are removed from the solvent composition at a central location during the solvent removal step.

8. The method of cleaning articles according to claim 5, wherein the solvent composition is vented after a single use with or without separation of soluble contaminants.

9. The method of cleaning articles according to claim 1, wherein at least a portion of the solvent composition is withdrawn from the pressure vessel and recirculated back to the pressure vessel during the removal of particulate contaminants from the articles in the subcritical state.

10. The method of cleaning articles according to claim 9, wherein particulate contaminants are removed from the solvent composition continuously during said recirculation.

11. The method of cleaning articles according to claim 9, wherein particulate contaminants are removed from the solvent composition at a central location during the solvent removal step.

12. The method of cleaning articles according to claim 9, wherein the solvent composition is vented after a single use with or without separation of particulate contaminants.

13. The method of cleaning articles according to claim 6, wherein the removal of the soluble contaminants is by a method selected from the group consisting of distillation, carbon adsorption, and membrane separation.

14. The method of cleaning articles according to claim 7, wherein the removal of the soluble contaminants is by a method selected from the group consisting of distillation, carbon absorption, and membrane separation.

15. The method of cleaning articles according to claim 10, wherein the removal of particulate contaminants from the solvent composition is performed by filtration.

16. The method of cleaning articles according to claim 11, wherein the removal of particulate contaminants from the solvent composition is performed by filtration.

17. The method of cleaning articles according to claim 1, wherein the agitation is provided by recirculating the solvent composition and reinjecting the solvent composition to the pressure vessel in the form of a jet.

18. The method of cleaning articles according to claim 1, wherein the agitation is provided by mechanical motion of the pressure vessel.

19. The method of cleaning articles according to claim 18, wherein the pressure vessel is provided with stationary baffles to provide greater agitation.

20. The method of cleaning articles according to claim 1, wherein the agitation is provided by motion of a mechanical device within the pressure vessel.

21. The method of cleaning articles according to claim 1, wherein the heating of the solvent to a supercritical state and cooling of the solvent back to a subcritical state is performed outside of the pressure vessel.

22. The method of cleaning articles according to claim 1, further comprising performing a rinse cycle or a second washing cycle before the unloading of the cleaned articles from the pressure vessel.

23. A cleaning apparatus for cleaning articles with a solvent composition comprising a supercritical fluid, the system comprising:

a pressure vessel;

a solvent composition supply;

pressurization and heating means for pressurizing and heating the solvent composition to a supercritical state;

depressurization and cooling means for depressurizing and cooling the solvent composition to a subcritical state;

agitation means for agitating the solvent composition within the pressure vessel;

recovery means for recycling at least a portion of the solvent composition by removing contaminants from the solvent composition; and control means for controlling the pressurization and heating means, the depressurization and cooling means, and the agitation means such that the system provides a first supercritical cleaning stage for removal of soluble contaminants and a second subcritical agitation cleaning stage for removal of particulate contaminants.

24. The cleaning apparatus according to claim 23, wherein the solvent composition supply includes a pressurized supply of a carbon dioxide based solvent.

25. The cleaning apparatus according to claim 23, further comprising a recirculation means for withdrawing the solvent composition from the pressure vessel and recirculating the solvent composition to the pressure vessel during the supercritical cleaning stage.

26. The cleaning apparatus according to claim 25, wherein the recirculation means includes a recovery system for removal of soluble contaminates from the solvent composition during recirculation.

27. The cleaning apparatus according to claim 25, wherein the recovery means removes soluble contaminants from the solvent composition at a central location.

28. The cleaning apparatus according to claim 25, further comprising a venting system for venting the solvent composition after a single use with or without separation of soluble contaminants.

29. The cleaning apparatus according to claim 23, further comprising a recirculation means for withdrawing the solvent composition from the pressure vessel and recirculating the solvent composition to the pressure vessel during the subcritical agitation cleaning stage.

30. The cleaning apparatus according to claim 29, wherein the recirculation means includes a recovery system for removal of particulate contaminants from the solvent composition during recirculation.

31. The cleaning apparatus according to claim 29, wherein the recovery means removes particulate contaminants from the solvent composition at a central location.

32. The cleaning apparatus according to claim 29, further comprising a venting system for venting the solvent composition after a single use with or without separation of particulate contaminants.

33. The cleaning apparatus according to claim 26, wherein the recovery system removes the soluble contaminants by a method selected from the group consisting of distillation, carbon adsorption, and membrane separation.

34. The cleaning apparatus according to claim 27, wherein the recovery system removes the soluble contaminants by a method selected from the group consisting of distillation, carbon absorption, and membrane separation.

35. The cleaning apparatus according to claim 30, wherein the recovery system removes the particulate contaminants from the solvent composition by filtration.

36. The cleaning apparatus according to claim 23, wherein the agitation means includes a drive device mounted on the outside of the pressure vessel for moving the pressure vessel.

37. The cleaning apparatus according to claim 36, wherein the pressure vessel is provided with interior stationary baffles to provide greater agitation.

38. The cleaning apparatus according to claim 23, wherein the agitation means includes a mechanical device within the pressure vessel.

39. The cleaning apparatus according to claim 23, wherein a plurality of pressure vessels are provided for performing separate cleaning operations.

40. The cleaning apparatus according to claim 23, further comprising a blow down drain within the solvent composition supply for removal of contaminants which are separated from the solvent composition.

41. The cleaning apparatus according to claim 23, further comprising a purging system for purging the pressure vessel after articles to be cleaned have been placed within the pressure vessel.

42. The cleaning apparatus according to claim 23, wherein the control means includes separate controllers for controlling the pressurization and heating means, the depressurization and cooling means, and the agitation means.

43. A cleaning apparatus for cleaning articles with a solvent composition comprising a supercritical fluid, the is system comprising:

a pressure vessel;

a solvent composition supply;

pressurization and heating means for pressurizing and heating the solvent composition to a supercritical state;

depressurization and cooling means for depressurizing and cooling the solvent composition to a subcritical state;

agitation means for agitating the solvent composition within the pressure vessel; and control means for controlling the pressurization and heating means, the depressurization and cooling means, and the agitation means such that the system provides a first supercritical cleaning stage for removal of soluble contaminants and a second subcritical agitation cleaning stage for removal of particulate contaminants.

* * * * *